United States Patent [19]

Kissel

[11] Patent Number: 4,783,010

[45] Date of Patent: Nov. 8, 1988

[54] METHOD AND DEVICE FOR PULVERIZING A SOLID FUEL MATERIAL

[75] Inventor: Roland Kissel, Le Vesinet, France

[73] Assignee: Creusot-Loire, Paris, France

[21] Appl. No.: 391,740

[22] Filed: Jun. 24, 1982

[30] Foreign Application Priority Data

Jul. 3, 1981 [FR] France ..... 81 13095

[51] Int. Cl.[4] ..... A23J 1/00

[52] U.S. Cl. ..... 241/3; 241/5; 241/18; 241/260.1

[58] Field of Search ..... 241/43, 5, 18, 40, 54, 241/57, 260.1; 425/72 R

[56] References Cited

U.S. PATENT DOCUMENTS 4,039,691 8/1977 Hildebolt ..... 425/72 R X
4,286,935 9/1981 Okuno et al. ..... 425/72 R

FOREIGN PATENT DOCUMENTS 14601 5/1976 Japan ..... 24/260.1

*Primary Examiner*—Timothy V. Eley
*Attorney, Agent, or Firm*—Pollock, Vande Sande & Priddy

[57] ABSTRACT

The invention relates to a method and device for pulverizing a solid fuel material introduced inside a vessel by means of a screw conveyor through a die opening within the vessel and in which is formed by extrusion a roll of compressed material, the latter being disintegrated by at least one gas jet injected under high pressure. According to the invention the gas is injected from the inside of the conveyor and in the axis of each die, each gas jet having a sufficient momentum to form substantially a cone centered on the axis of the roll widening from the inside of the latter, each roll being constituted by a hollow tube whose inner wall crumbles and takes the shape of the jet liberating particles which are sucked into the jet and introduced into the vessel. The invention is particularly applicable to supplying a gasifying reactor.

14 Claims, 2 Drawing Sheets

FIG.1
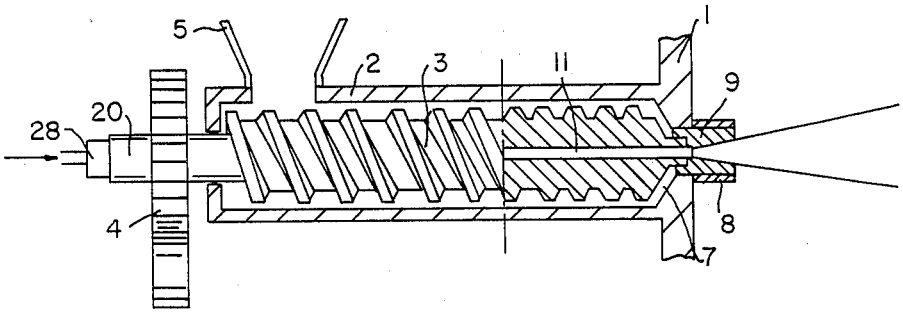
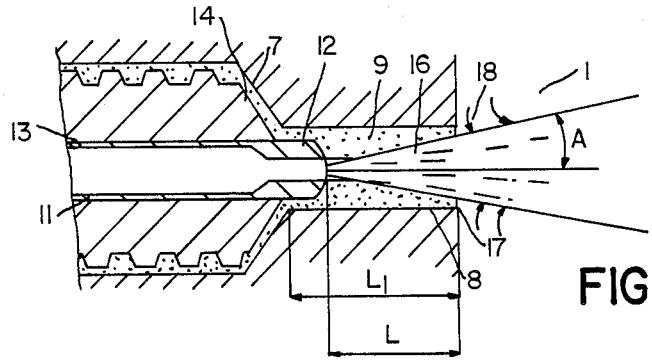
FIG.2
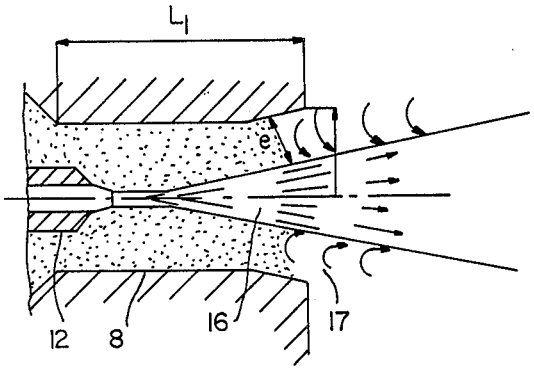
FIG.3
FIG.4
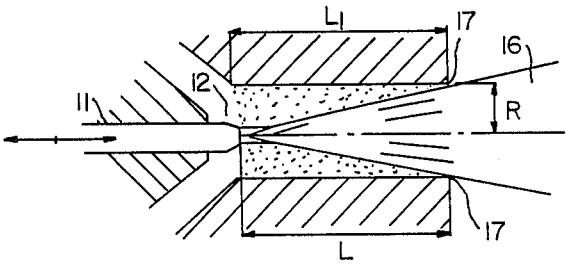

METHOD AND DEVICE FOR PULVERIZING A SOLID FUEL MATERIAL

FIELD OF THE INVENTION

The invention relates to a method and a device for fragmenting or pulverizing the solid fuel material introduced inside a vessel by means of a screw conveyor.

The invention is especially applicable to the introduction of fragmented solid fuel into a reaction chamber to effect the combustion or gasification thereof, whether or not the combustion chamber is pressurized.

BACKGROUND

To introduce fragmented solid fuel into a vessel, particularly when the vessel must be kept under pressure, it has already been proposed to use a screw conveyor constituted by one or several screws rotated inside a sleeve provided at its upstream end with an orifice for the intake of the material and at its downstream end with at least one die opening through an outlet orifice inside the vessel and in which a slab or roll of compressed material is formed by extrusion. In this way, the solid fuel can be introduced continuously into the vessel while maintaining the fluid-tightness of the latter due to the compression of the material obtained in the die.

As a result, particularly when the vessel is under considerable pressure, the roll introduced is very compact and it is necessary to disintegrate it to carry out the combustion or gasification thereof. To this end, it is possible to use a gas jet injected under high pressure on to the roll emerging from the die. However, because the roll is very compact, it is not certain, with such a method, that true pulverization of the fuel can be effected, the roll being breakable into lumps of a certain size.

On the other hand, by this method one is led, to ensure the disintegration of the roll, to inject into the vessel a considerable delivery rate of gas risking reduction in the energy yield of combustion or of the gasification of the fuel.

It is an object of the invention to provide a method and device enabling these drawbacks to be remedied while ensuring, even for relatively low gas flow rate, perfect pulverization of the fuel introduced.

SUMMARY OF THE INVENTION

According to the invention, a gas jet is injected into the axis of each die from the inside of the screw conveyor, each gas jet having a sufficient momentum to form an appreciable cone centered on the axis of the roll of compressed material in expanding inside the latter, each roll being constituted by a hollow tube whose inner wall crumbles in the course of its advance in the die and takes the form of the jet while liberating particles which are sucked into the jet and introduced with it into the vessel.

According to an additional feature, the origin of the jet and its momentum is determined so that the cone formed reaches a diameter of the order of that of the outlet orifice of the die, in the plane of the latter.

The invention will now be described, with reference to several embodiments, given purely by way of example and shown in the accompanying drawings.

BRIEF DESCRIPTION OF THE DRAWINGS

FIG. 1 shows, in section along the axis of a screw, a screw conveyor for introducing solid material, provided with an embodiment of the pulverizing device according to the invention.

FIG. 2 is a view in axial section on an enlarged scale of a shaping die for a compressed roll.

FIG. 3 and FIG. 4 show two particular embodiments of the pulverizing gas jet.

DETAILED DESCRIPTION

Figure 5:
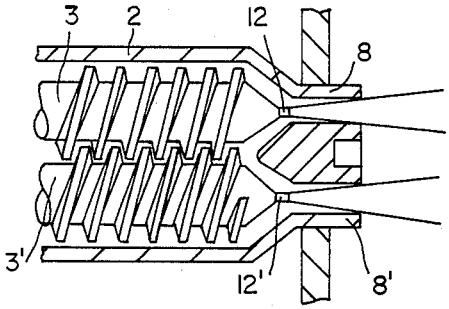
FIG. 5 shows an embodiment of the invention in the case of a dual screw conveyor.

FIG. 1 shows by way of example a vessel bounded by a wall 1 within which a roll of fuel material is introduced by means of a screw conveyor constituted by a sleeve 2 within which the screw 3 is driven by a motor, through a reducing gear 4. The rotation of the screw causes fuel material introduced through a hopper 5 supplied with fuel to be carried along, the latter being led in, for example, pneumatically or hydraulically. At its downstream end, the sleeve 2 is provided with a convergent part 7 which directs the material driven by the screw 3 to a die 8 opening inside the vessel 1.

If the operating characteristics of the screw conveyor are directly chosen, the latter forms, by extrusion inside the die 8, a roll of compressed material 9 which is introduced continuously into the vessel 1.

According to the invention, the shaft of the screw 3 is pierced by an axial bore 13 in which is formed a channel 11 which opens at the end of the screw through an injection nozzle 12.

In FIG. 2, which is a view on an enlarged scale of the end of the screw and of the die 8, it is seen that the channel 11 can be constituted by a tube inserted into the axial bore 13 of the shaft of the screw 3 and terminated by the nozzle 12, the latter being placed in extension of the conical tip 14 located at the end of the shaft 3 of the screw and penetrating into the conical convergent part 7. If the conduit 11 is rotated with the shaft 3 of the screw, it is necessary to supply it through a rotary seal 20 of known type. However, the conduit 11 may also be blocked in rotation, the shaft 3 rotating around itself.

Through the nozzle 12 is thus injected, into the inside of the roll of compressed material 9, a gas jet 16 which traverses the roll along the axis of the latter before emerging inside the vessel 1.

It is known that a gas jet of high momentum always takes up substantially the shape of a cone whose apex is located at the center of the injection nozzle and whose half-angle at the apex A is of the order of 11°.

According to the invention, it is advantageous to adjust the momentum of the jet so that at the outlet of the nozzle 12, the latter has a speed comprised between 50 m/s and the speed of sound. This assures that the jet is in the form of a cone which widens starting from the center of the nozzle 12. The roll 9 is then constituted by a hollow tube traversed along its axis by the jet 16 and wall whose inner wall takes the form of the jet. In fact, if the momentum is sufficient, the jet preserves its geometrical characteristics within the roll, the inner wall of the latter being disintegrated in the course of its advance and taking up the shape of the jet.

To achieve this effect, it is necessary to place the nozzle 12 upstream of the die 23 and to give the latter a rather unusual length $L_1$, greater than 1.5 times its diameter. However this elongation of the die, through the frictional effect which results therefrom, increases the compression of the material and hence facilitates the formation of the roll of compressed material 9.

The crumbling process of the roll is particularly effective at the outlet of the die if the position of the nozzle 12 is selected so that, in the plane of the outlet orifice 17 of the die, the jet 16 is widened until it reaches a diameter of the order of that of the outlet orifice 17. In fact, the roll 9, which advances continuously towards the inside of the vessel has, in the outlet orifice 17, a thickness of little magnitude and hence crumbles easily. On the other hand, it is known that a high momentum jet sucks in the gases which surround it, and there are hence produced at the periphery of the jet gas flows directed along the arrows 18 and having a relatively high speed, of the order of 3 m/s. These currents contribute to the crumbling of the wall of the roll, and the particles which are thus detached are sucked with the gas currents 18 into the jet 16 to be projected by the latter into the vessel 1.

The efficiency of this disintegration by erosion depends obviously on the compactness of the roll and the thickness of the wall of the latter at the outlet of the die.

When the roll disintegrates easily, it is possible to allow it to assume a relatively large thickness. This will be the case, for example, if the fuel is dry coal or indeed if the vessel is not at very high pressure, necessitating, to maintain fluid-tightness, the formation of a very compact roll. The distance (L) of the nozzle to the outlet surface of the die may then be of the order of 1.5 times the diameter (d) of the latter.

In this case, it is possible to use the device of FIG. 3 in which the die widens close to the outlet orifice 17 in taking up the shape of a conical frustum of apex angle equal to that of the jet 7. Such a device enables the wear of the edges of the outlet orifice 17 of the die 8 to be reduced.

On the other hand, if the roll is very compact, one will attempt to reduce as much as possible the thickness of the wall of the roll at the outlet 17 of the die, and the device of FIG. 4 will be adopted, for which the injection nozzle 12 is placed at a distance (L) from the outlet orifice 17 of the die so that the cone 16 has, in the plane of the outlet orifice 17, a diameter substantially equal to that of the orifice.

In this case, the distance L of the nozzle to the outlet surface of the die is of the order of 2.5 times the diameter (d) of the outlet orifice.

If the compactness of the roll varies, it is possible to use a device enabling the position of the injection nozzle 12 to be adjusted inside the die 16, so as to modify the thickness of the wall of the roll. This will be the case particularly if the nature of the fuel is changed, greasy coals risking, for example, the formation of very compact rolls, whereas dry coals disintegrate more easily. To this end, the conduit 11 can be mounted slidably along the bore 13 of the shaft of the screw, the latter being provided with a device 28, for example by nut and screw, enabling the position of the outlet nozzle 12 to be adjusted by sliding the conduit 11 within the shaft.

It will be noted in addition that, if the nozzle 12 is made to extend into the entrance of the die 8, the nozzle plays the roll of a mandrel facilitating the formation in the die of a roll of tubular shape.

The foregoing description has been provided with reference to a single screw, but is is quite obvious that the same device can be applied to a conveyor with several screws if there is placed, as shown in FIG. 5, a die 8, 8' opposite each screw 3, 3' with, at the center of each die, a nozzle 12, 12', supplied through a conduit pierced in the axis of the corresponding screw.

This arrangement is particularly advantageous since, for the same flow rate of fuel material, the use of several dies enables the thickness of the roll of compressed material to be reduced and facilitates disintegration of the latter.

Figure 6:
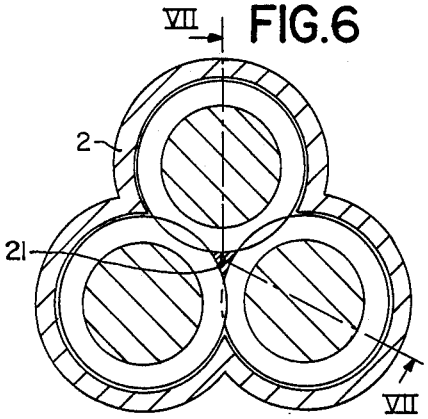
FIG. 6 shows, in cross-section, a triple screw conveyor, FIG. 7 being an axial section along the line VII—VII of FIG. 6.
Figure 7:
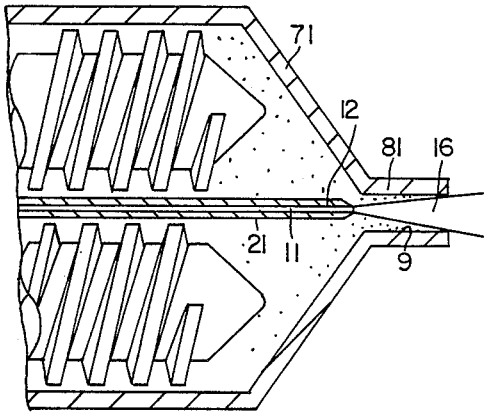
Figure 8:
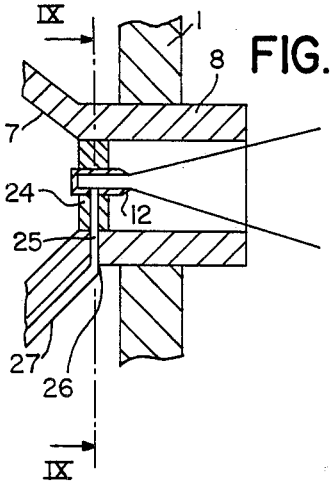
FIG. 8 is an axial sectional view of another embodiment of the pulverizing device according to the invention.

However, in the case where the screw conveyor comprises three screws and a single die at the center of the latter, it is still possible to use an axial conduit emerging at the center of the die, as shown in FIGS. 6, 7 and 8.

In FIG. 6, which is a section through a plane transverse to the axis of the screw, it is seen that the latter are arranged so as to penetrate into one another and distributed around a strut 21 placed in the axis of the sleeve 2 and whose cross-section has the shape of a curvilinear triangle inscribed in the threads of the three screws. It is possible, as has been shown in FIGS. 7 and 8, to position an injection channel 11 inside the central strut 21.

In the case of FIG. 7, three screws propel the impelled material towards a single convergent part 71 which opens into a die 81 located in the axis of the sleeve 2. Consequently, a channel 11 located in the strut 21 opens through a nozzle 12 to the center of the die 81. The pulverizing of the fuel is then effected as described previously, the jet 16 produced by the nozzle 12 widening within the single roll 9.

Figure 9:
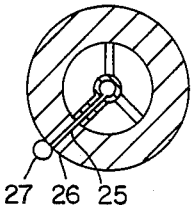
FIG. 9 is a cross-sectional view along the line IX—IX, of FIG. 8.

In all the previously described embodiments, the nozzle 12 was supplied through an axial passage 11. This arrangement is advantageous since it permits the die 8 to be disengaged, but it would also be possible to adapt the arrangement shown in FIGS. 8 and 9.

In this case, in fact, the nozzle 12 is constituted by a short tube section forming a spray nozzle upstream and open downstream, and held at the center of the die 8 upstream of the latter, by at least one fin 24 within which is pierced a channel 25 opening at one end into the nozzle 12 and at the other end outside the die 8 through an orifice 26 connected to a fluid supply pipe 27.

The fins 24 are of such profile as not to impede the advance of the material and not to interfere with the formation of the roll. In addition, by inclining the fins 24, it is possible to place the nozzle 12 at least partly at the tip of the convergent part so as to clear better the input orifice of the die 23.

The invention applied in the various embodiments which have been described enable the fuel material to be suspended with a relatively low weight of gas in flow, of the order of 2 to 20% by weight of the solid flow rate, the ratio of the pressure of the fluid in the injection pipe 11 to the pressure existing inside the vessel being comprised, for example, between 2, for a gas flow rate of 10% of solid, and 3 for a flow rate of 3%.

On the other hand, to obtain a jet preserving its geometrical characteristics inside the roll, it is possible to calculate that the momentum must be at least equal to 30 Newtons per ton/hour of coal.

Figure 10:
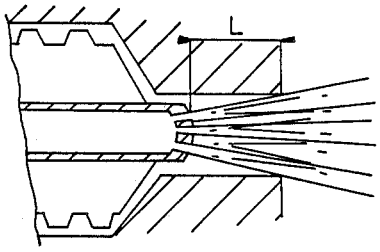
FIG. 10 shows an axial section of another embodiment of the gas jet.

All the described embodiments comprised that of an injection nozzle having a single injection orifice, but the same result could be obtained, as shown in FIG. 10, with several orifices distributed around the axis of the nozzle, giving a conical overall jet centered on the axis. The number and the diameter of the orifices will be calculated as a function of the pressure in the injection pipe to obtain the desired momentum. It is then possible to obtain a more open jet, which permits, with a little less expenditure of energy, the distance (L) of the nozzle to the outlet surface of the die to be reduced.

In addition, if the injected jet must necessarily be constituted by a compressible fluid, the latter could nevertheless contain a certain amount of liquid in suspension.

I claim:

1. Method of pulverizing a solid fuel material introduced inside a pressurized reaction chamber by means of a screw conveyor constituted by at least one screw rotated within a sleeve provided at an upstream end with an inlet orifice for the material in divided form and at a downstream end with at least one die having an axis and opening through an outlet orifice inside said chamber, including the steps of (a) forming by extrusion a roll of compressed material having an axis; and (b) injecting at least one gas jet under high pressure from the inside and into said axis of said die to disintegrate said roll, said gas being injected with sufficient momentum to form an appreciable cone centered on said axis of said roll widening from the inside of the latter, each roll comprising a hollow tube having an inner wall which crumbles as it advances into said die and assumes the shape of said jet, thereby freeing particles which are drawn into the jet and introduced with it into said chamber.

2. Pulverizing method according to claim 1, wherein said outlet orifice is located in a plane, and the origin of the jet and its momentum are such that said cone attains a diameter substantially equal to that of said outlet orifice of said die, in said plane of the latter.

3. Pulverizing method according to claim 1, wherein the momentum of the gas jet is at least equal to 30 Newtons per ton/hour of injected fuel.

4. Pulverizing method according to claim 1, wherein the mass flow rate of injected gas is in the range of 2% to 20% of the fuel flow rate introduced through said die.

5. Pulverizing method according to any one of claims 1 to 4, including adjusting the momentum of said jet so that the speed of the gas at the point where it is injected into said roll is in the range of 50 m/s and the speed of sound.

6. Device for pulverizing a solid fuel material introduced in tubular form inside a pressurized chamber, comprising a screw conveyor constituted by at least one screw rotated inside a sleeve provided at an upstream end with a feed orifice for fuel material and at a downstream end with at least one die emerging inside said chamber through an outlet orifice, located in a plane, forming a roll of compressed material and at least one injection nozzle for a gas jet under high pressure for the disintegration of said compressed material, said nozzle being located at a distance upstream of said outlet orifice of said die such that, given the momentum of the jet, the latter widens into conical form within said roll until a diameter of the order of that of said outlet orifice of said die in the plane of the latter is reached.

7. Pulverizing device according to claim 6, wherein the screw conveyor comprises at least two screws, each having an axis, and two dies, each having an axis and being centered on the axis of a screw, each die being associated with a gas injection nozzle located on its axis.

8. Pulverizing device according to claim 6 or 7, wherein the injection nozzle associated with each at least one die is constituted by a tube section closed upstream and open downstream and held in the axis of the upstream part of the die by at least one profiled fin within which is formed a channel opening at one end in the associated injection nozzle and at the other end outside of the die through orifices connected to a gas supply pipe.

9. Pulverizing device according to claim 6 or 7, wherein, each at least one injection nozzle is placed at the end of a supply pipe formed along the axis of the corresponding screw.

10. Pulverizing device according to claim 9, wherein each at least one die being placed at the bottom of a convergent part into which a conical tip plcaed at the end of the corresponding screw penetrates, the associated injection nozzle is placed in an extension of the conical tip and penetrates inside the die to constitute a mandrel cooperating with the die for the formation of a hollow roll.

11. Pulverizing device according to claim 6, wherein the screw conveyor comprising three screws meshing with one another and distributed around a central strut filling the space comprised between the screws at the center of the sleeve enveloping the screws externally, a supply pipe of the gas jet is formed in the axis of the sleeve, within the central strut.

12. Pulverizing device according to claim 9, wherein the pipe is slidably mounted along a bore pierced in the axis of the screw, the latter being provided with an adjusting device for the position of the injection nozzle by sliding of the pipe.

13. Pulverizing device according to claims 6 or 7, wherein each at least one injection nozzle comprises a plurality of orifices whose axes are distributed around the axis of the nozzle and are directed so as to form a single jet which widens into conical shape.

14. Pulverizing device according to claim 6 or 7, wherein said nozzle is located upstream of the outlet orifice of the die, the distance of said nozzle from said outlet orifice being in the range of 1.5 to 2.5 times the diameter of said outlet orifice.

* * * * *